US006385955B1

(12) United States Patent
Rowlands et al.

(10) Patent No.: US 6,385,955 B1
(45) Date of Patent: May 14, 2002

(54) ADJUSTABLE HEIGHT SELF-LUBRICATING PULLEY SYSTEM FOR USE WITH A FLYER BOW

(75) Inventors: David B. Rowlands, Broad Brook; Scott Scranton, Wallingford, both of CT (US)

(73) Assignee: Kamatics Corporation, Bloomfield, CT (US)

( * ) Notice: Subject to any disclaimer, the term of this patent is extended or adjusted under 35 U.S.C. 154(b) by 0 days.

(21) Appl. No.: 09/729,400

(22) Filed: Dec. 4, 2000

(51) Int. Cl.[7] ..... D01H 7/24; D01H 1/04
(52) U.S. Cl. ..... 57/67; 57/58.83; 57/352
(58) Field of Search ..... 57/67, 115, 58.52, 57/58.83, 352

(56) References Cited

U.S. PATENT DOCUMENTS 3,309,857 A * 3/1967 Haugwitz ..... 57/58.83
3,564,931 A * 2/1971 Bonnabaud et al. ..... 57/58.52
3,574,423 A 4/1971 Thomson
3,945,182 A * 3/1976 Dover et al. ..... 57/58.52
4,012,932 A 3/1977 Gewiss
4,075,902 A 2/1978 Charchian et al.
4,164,331 A 8/1979 Henrich
4,446,688 A * 5/1984 Ueda ..... 57/58.65
4,541,401 A 9/1985 Caldwell
5,605,141 A 2/1997 Bilotta

* cited by examiner

*Primary Examiner*—Andy Falik
(74) *Attorney, Agent, or Firm*—Cantor Colburn LLP

(57) ABSTRACT

An adjustable height self-lubricating pulley system for use on the flyer bow of a twisting machine that twists strands. The height of the pulley can be adjusted to control the distance of the cable from the flyer bow during the cable's path along the flyer bow by selectively mounting the pulley spindle in one of a plurality of apertures in a pair of side plates of the pulley. The pulley is self-lubricating by virtue of the pulley spindle being coated with a self-lubricating liner system including polytetrafluoroethylene and other fillers in a resin system.

26 Claims, 1 Drawing Sheet

ADJUSTABLE HEIGHT SELF-LUBRICATING PULLEY SYSTEM FOR USE WITH A FLYER BOW

BACKGROUND

This invention relates broadly to the art of flyer bows, which are used in machines which twist strands into cable for a wide variety of uses, such as electrical cable and textiles. Flyer bows can be used for pairing, tripling, quading, and bunching machines for twisting wire into cables. A typical construction and operation of a twisting machine and flyer bow is disclosed and described in U.S. Pat. No. 3,945,182, the entire contents of which are incorporated by reference. More specifically, the invention relates to the use of pulleys in combination with wireguides (e.g., eyelets) and a flyer bow to guide strands along the flyer bow. The use of pulleys on flyer bows to guide strands of wire is known in the art. U.S. Pat. No. 4,302,924, the entire contents of which are incorporated by reference, discloses an exemplary wire stranding machine which uses pulleys to guide stranded wire. Conventional pulleys are retained in a fixed height relative to the flyer bow and thus, lack the ability to adjust the path of the wire strand to clear attaching hardware, mounts, or other machine features. Further, conventional pulleys require either frequent replacement of bearings due to failure caused by contamination or debris generated during the wire twisting process, or the periodic manual lubrication thereof Both of these interventions cause a disruption of the twisting process, costing the manufacturer time and money.

SUMMARY OF THE INVENTION

An embodiment of the invention is a flyer bow assembly including a flyer bow and a pulley. The flyer bow has a top surface and a bottom surface. The pulley includes a pulley support secured to the flyer bow at the bottom surface. The pulley also includes a pulley wheel adjustably mounted on the pulley support such that the distance between the pulley wheel and the flyer bow can be adjusted.

DESCRIPTION OF THE PREFFERED EMBODIMENT

A description of the preferred embodiment of the present invention will now be had by way of example, and not limitation, with reference to FIGS. 1 through 6.

Figure 1:
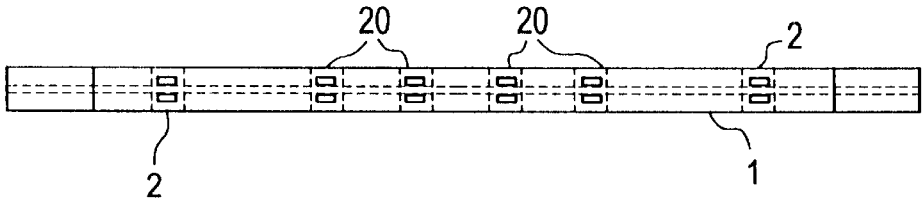
FIG. 1 is a top view of a flyer bow.
Figure 2:
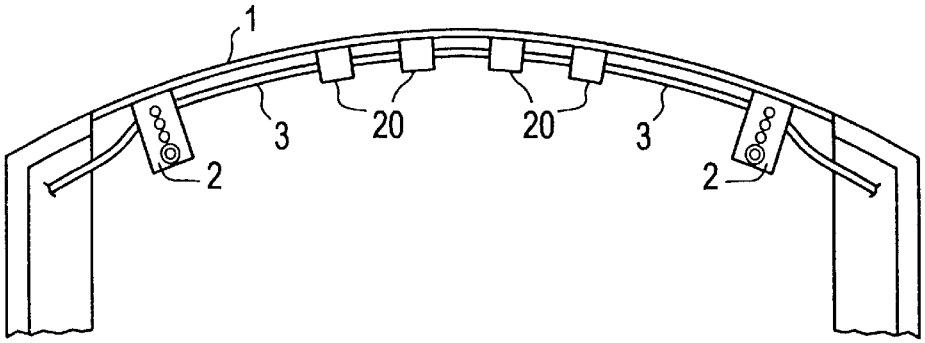
FIG. 2 is a side view of the flyer bow of FIG. 1, with adjustable height self-lubricating pulleys mounted thereon.

FIG. 1 is a top view of a flyer bow 1. Attached to the flyer bow 1 are a plurality of adjustable height, self-lubricating pulleys 2 and a plurality of conventional wireguides 20 such as eyelets. FIG. 2 is a side view of the flyer bow of FIG. 1. Any number of pulleys 2 and wireguides 20 may be affixed to the flyer bow 1. In a preferred embodiment, pulleys 2 are placed at the distal ends of the flyer bow 1 with wireguides 20 disposed between the adjustable pulleys 2. It can be seen that the flyer bow 1 is in the form of a generally U-shaped arm. The adjustable height self-lubricating pulleys 2 serve to guide strands 3 (e.g., wire) on to the path of the flyer bow 1. The flyer bow 1 may have an airfoil shape.

Figure 3:
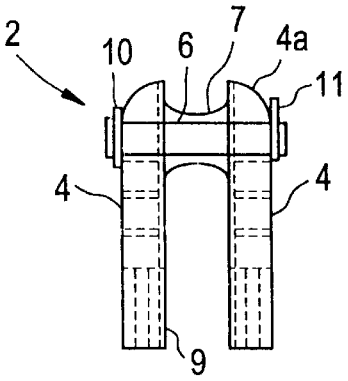
FIG. 3 is a side view of the adjustable height self-lubricating pulley.
Figure 4:
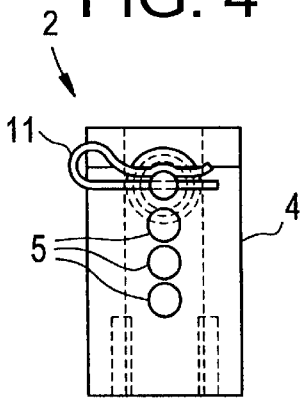
FIG. 4 is an end view of the adjustable height self-lubricating pulley of FIG. 3.
Figure 5:
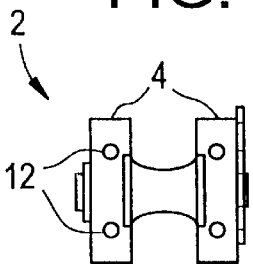
FIG. 5 is a bottom view of the adjustable height self-lubricating pulley of FIG. 3.
Figure 6:
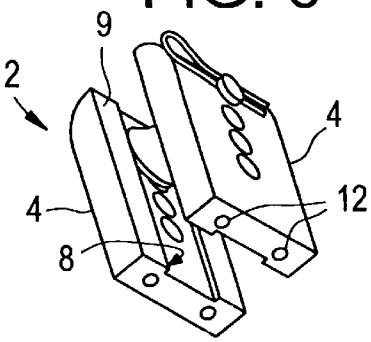
FIG. 6 is a perspective view of the adjustable height self-lubricating pulley of FIG. 3.

FIGS. 3–6 are various views of an adjustable height self-lubricating pulley 2 of the invention. The pulley 2 comprises two side plates 4 each having a radiused outer surface 4*a* to improve aerodynamircs, and a plurality of apertures 5, with each aperture 5 in one side plate 4 having a corresponding aperture 5 at the same position on the other side plate 4. The side plates 4 serve to support the spindle 6 and wheel 7 of the pulley 2. Mounted between a pair of these corresponding apertures 5 is a fixed, i.e. non-rotating, spindle 6 which supports thereon a freely rotating wheel 7. The wheel 7, when viewed from the side, is substantially hourglass shaped or double "v" shaped; thicker on the ends, and thinner towards its middle. This shape serves to guide the strand 3 towards the middle of the wheel 7, away from the side plates 4. Additionally, the wheel 7 is recessed into the side plates 4, as best seen in FIGS. 3, 5 and 6. FIG. 6 shows a channel 8 on the interior face 9 of each side plate 4, which receives an end of wheel 7, thereby recessing the wheel 7. The recessing of the wheel 7 into the side plates 4, combined with the hourglass or "v" shape of the wheel 7 itself, prevents the strand 3 from being pinched between the wheel and the side plates 4 and promotes smooth operation of the device.

Prior to use, an operator determines the optimal height of the pulley given the various machine features of the flyer bow 1, selects an appropriate pair of apertures 5 on the respective side plates 4 which corresponds to the desired height, and mounts the spindle 6 and wheel 7 between these two apertures 5. A washer 10 on one end of the spindle 6, and a removable cotter pin 11 on the other end of the spindle 6 secure the spindle 6 in the selected aperture 5. As best seen in FIGS. 5 and 6, the bottom of each side plate 4 has holes 12 bored therein to receive fasteners (not shown) to mount the pulley 2 to the flyer bow 1.

The current state of the art design utilizes grease or oil lubricated bearings. The operation of wire twisting machines typically creates wire dust which is attracted to the grease or oil in the bearing. This wire dust contamination causes the life of a lubricated bearing system to be significantly shortened.

To address these disadvantages, a second feature of the invention is that the pulley 2 has a maintenance-free, self-lubricating bearing system. The spindle 6 or the inner diameter of the wheel 7 is coated with a machineable self-lubricating liner system that includes polytetrafluoroethylene and other fillers in a resin system. This type of self-lubricating bearing system is very tolerant to foreign contamination. This greatly reduces wear on the pulley 2 without the need for manually lubricating the system, thereby extending the useful life of the pulley 2.

The preferred material for the pulley 2 is aluminum. The light weight of this material results in less centrifugal stress on the flyer bow 1 due to decreased pulley assembly weight as compared to systems which use heavier materials such as steel. The end result is longer flyer bow life. In the event the pulley 2 does need replacement or adjustment, all components may be replaced while the flyer bow 1 is still on the twisting machine.

It is to be understood the preferred embodiment of this invention herein disclosed and illustrated, is by way of illustration, and not of limitation, and that changes and modifications can be made without departing from the spirit or scope of this invention.

What is claimed is:

1. A flyer bow assembly comprising:

a flyer bow having a top surface and a bottom surface; and a pulley comprising:

a pulley support secured to said flyer bow at said bottom surface; and a pulley wheel adjustably mounted on said pulley support such that the distance between said pulley wheel and said flyer bow can be adjusted.

2. The flyer bow assembly of claim 1 wherein:

said pulley support includes a pair of side plates, each side plate having a plurality of apertures formed therein;

said flyer bow assembly further includes a spindle releasably supported between one of said plurality of apertures on a first one of said side plates and one of said plurality of apertures on a second one of said side plates; and said pulley wheel is mounted on said spindle such that it rotates freely thereon.

3. The flyer bow assembly of claim 2 wherein said apertures are positioned in sequentially increasing distances from said flyer bow.

4. The flyer bow assembly of claim 2 wherein said side plates have radiused outer surfaces.

5. The flyer bow assembly of claim 2 wherein a bottom surface of each of the side plates has at least one hole therein to receive a mounting fastener for mounting the pulley to the flyer bow.

6. The flyer bow assembly of claim 2 wherein the pulley wheel is recessed into the side plates.

7. The flyer bow assembly of claim 1 wherein said pulley is self-lubricating.

8. The flyer bow assembly of claim 6 wherein each of the side plates has a channel on an interior face thereof, each channel receiving a respective end of the pulley wheel, such the pulley wheel is recessed.

9. The flyer bow assembly of claim 6 wherein the self-lubricating is achieved by the spindle being coated with a machineable self-lubricating liner system.

10. The flyer bow assembly of claim 9 wherein the machineable self-lubricating liner system includes potytetrafluoroethylene and fillers in a resin system.

11. The flyer bow assembly of claim 1 wherein the pulley wheel has ends and a middle, said ends being thicker than said middle.

12. The flyer bow assembly of claim 1 wherein the pulley is made of aluminum.

13. The flyer bow assembly of claim 1 further comprising a plurality of said pulleys secured to said flyer bow.

14. A twisting machine having a flyer bow assembly, the flyer bow assembly comprising:

a flyer bow having a top surface and a bottom surface; and a pulley comprising:

a pulley support secured to said flyer bow at said bottom surface; and a pulley wheel adjustably mounted on said pulley support such that the distance between said pulley wheel and said flyer bow can be adjusted.

15. The twisting machine of claim 14 wherein:

said pulley support includes a pair of side plates, each side plate having a plurality of apertures formed therein;

said flyer bow assembly further includes a spindle supported between one of said plurality of apertures on a first one of said side plates and one of said plurality of apertures on a second one of said side plates; and said pulley wheel is mounted on said spindle such that it rotates freely thereon.

16. The twisting machine of claim 15 wherein said apertures are positioned in sequentially increasing distances from said flyer bow.

17. The twisting machine of claim 15 wherein said side plates have radiused outer surfaces.

18. The twisting machine of claim 15 wherein a bottom surface of each of the side plates has at least one hole therein to receive a mounting fastener for mounting the pulley to the flyer bow.

19. The twisting machine of claim 15 wherein the pulley wheel is recessed into the side plates.

20. The twisting machine of claim 19 wherein each of the side plates has a channel on an interior face thereof, each channel receiving a respective end of the pulley wheel, such the pulley wheel is recessed.

21. The twisting machine of claim 14 wherein said pulley is self-lubricating.

22. The twisting machine of claim 21 wherein the self-lubricating is achieved by the spindle being coated with a machineable self-lubricating liner system.

23. The twisting machine of claim 22 wherein the machineable self-lubricating liner system includes polytetafluoroethylene and filers in a resin system.

24. The twisting machine of claim 14 wherein the pulley wheel has ends and a middle, said ends being thicker than said middle.

25. The twisting machine of claim 14 wherein the pulley is made of aluminum.

26. The twisting machine of claim 14 further comprising a plurality of said pulleys secured to said flyer bow.

* * * * *

UNITED STATES PATENT AND TRADEMARK OFFICE

CERTIFICATE OF CORRECTION

PATENT NO. : 6,385,955 B1 
DATED : May 14, 2002
INVENTOR(S) : David B. Rowlands et al.

It is certified that error appears in the above-identified patent and that said Letters Patent is hereby corrected as shown below:

Column 1,
Line 29, after "thereof", insert therefor -- . --

Column 2,
Line 10, after "improve", delete "aerodynamircs" and insert therefor -- aerodynamics --.

Column 3,
Line 45, after "includes", delete "potytetrafluoroethylene" and insert -- polytetrafluoroethylene --.

Column 4,
Line 44, after "and", delete "filers" and insert therefor -- fillers --.

Signed and Sealed this

Second Day of August, 2005

JON W. DUDAS
*Director of the United States Patent and Trademark Office*